US009581957B2

(12) United States Patent
Kamiya

(10) Patent No.: US 9,581,957 B2
(45) Date of Patent: Feb. 28, 2017

(54) IMAGE FORMING APPARATUS AND DETACHABLE COMPONENT

(71) Applicant: FUJI XEROX CO., LTD., Tokyo (JP)

(72) Inventor: Shogo Kamiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/047,004

(22) Filed: Feb. 18, 2016

(65) Prior Publication Data

US 2017/0023909 A1 Jan. 26, 2017

(30) Foreign Application Priority Data

Jul. 24, 2015 (JP) ..... 2015-146799

(51) Int. Cl.
*G03G 15/16* (2006.01)
*G03G 21/16* (2006.01)

(52) U.S. Cl.
CPC ..... *G03G 21/1647* (2013.01); *G03G 21/1685* (2013.01); *G03G 2221/1639* (2013.01)

(58) Field of Classification Search
CPC ..... G03G 21/1647; G03G 21/1685; G03G 2221/1639
USPC ..... 399/122
See application file for complete search history.

(56) References Cited

U.S. PATENT DOCUMENTS

2012/0020701 A1* 1/2012 Sato ..... G03G 21/1685 399/122

FOREIGN PATENT DOCUMENTS

JP 2009-053563 A 3/2009

* cited by examiner

*Primary Examiner* — Hoang Ngo
(74) *Attorney, Agent, or Firm* — Oliff PLC

(57) ABSTRACT

An image forming apparatus includes an apparatus body, a detachable component attachable to and detachable from the apparatus body, a secured part that is provided in the detachable component and that is secured to a predetermined securing position on an apparatus body side, and a regulating part that is provided on the apparatus body side and that regulates a movement of the secured part secured to the securing position. During attachment of the detachable component to the apparatus body, the secured part is brought into contact with the regulating part so as to be displaced or set in a state changed from a state before the contact of the secured part with the regulating part, and the secured part that is displaced or set in the changed state becomes able to pass the regulating part so as to reach the securing position.

14 Claims, 11 Drawing Sheets

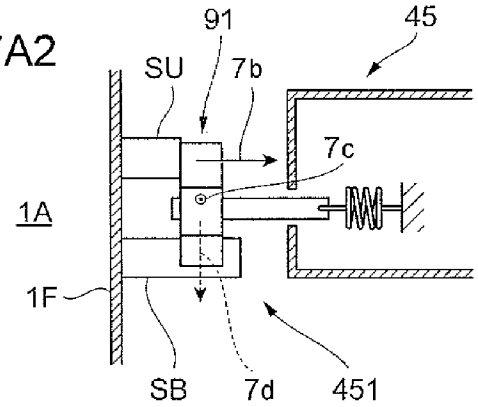
FIG. 7A2
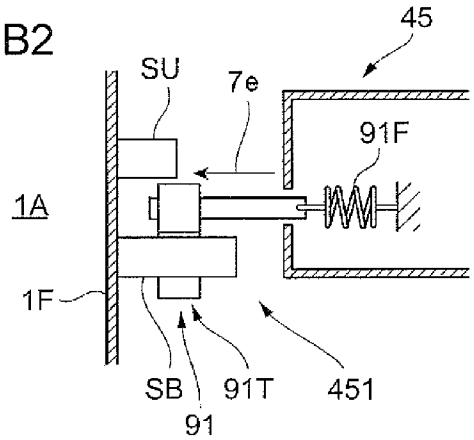
FIG. 7B2
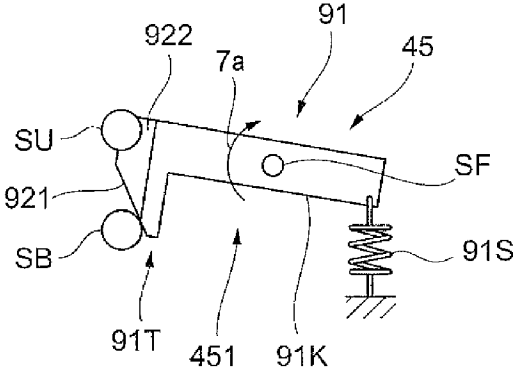
FIG. 7A1
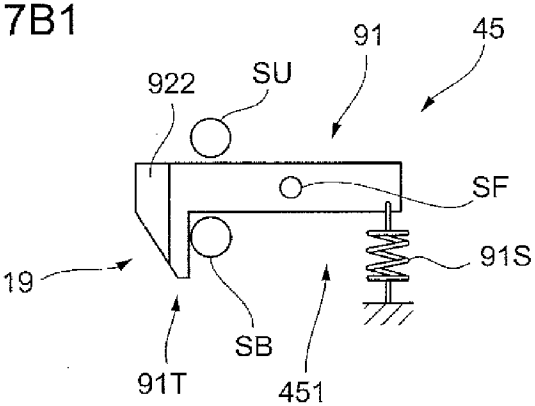
FIG. 7B1

FIG. 9A1
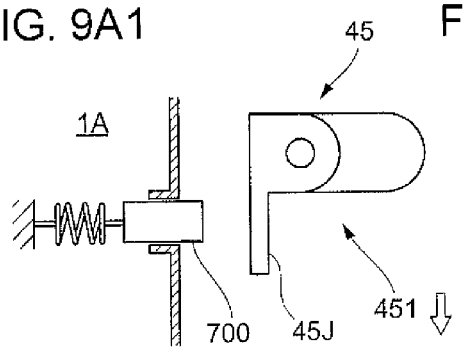
FIG. 9A2
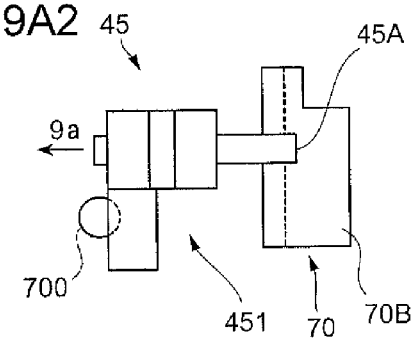
FIG. 9B1
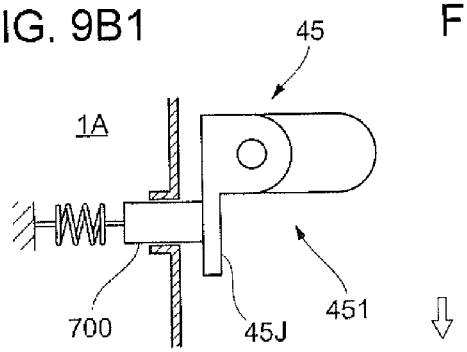
FIG. 9B2
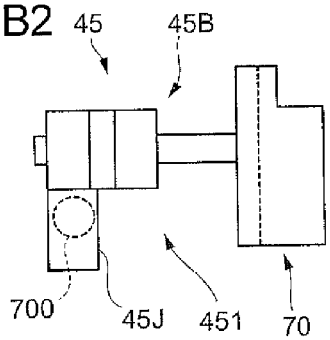
FIG. 9C1
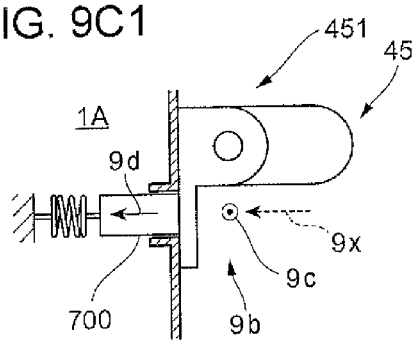
FIG. 9C2
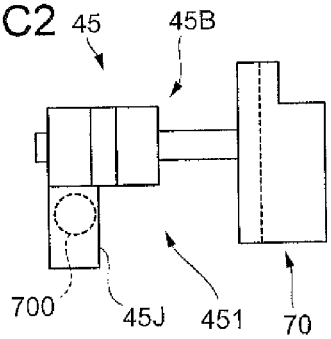
FIG. 9D1
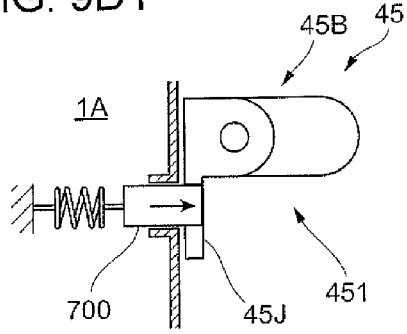
FIG. 9D2
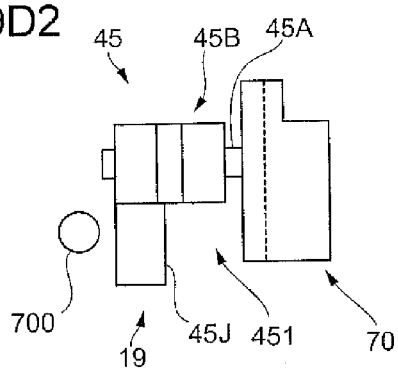

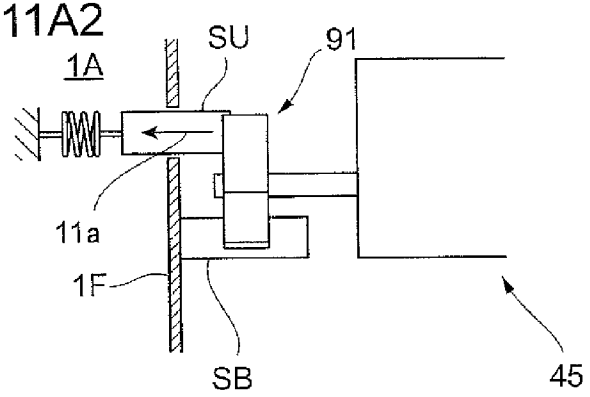
FIG. 11A2
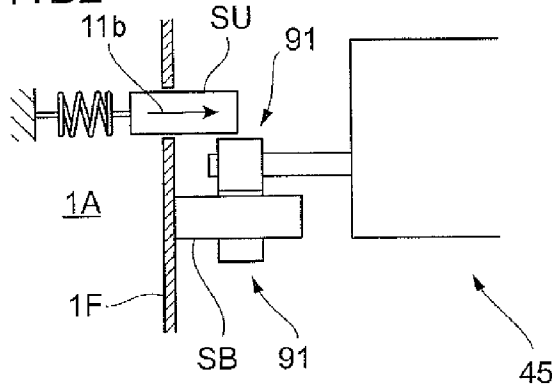
FIG. 11B2
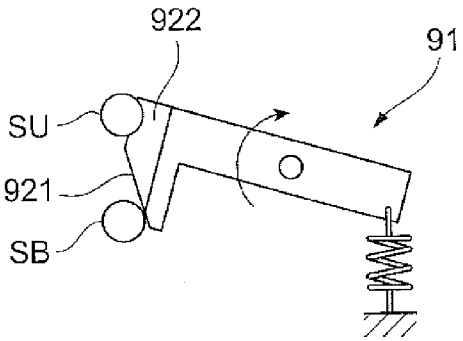
FIG. 11A1
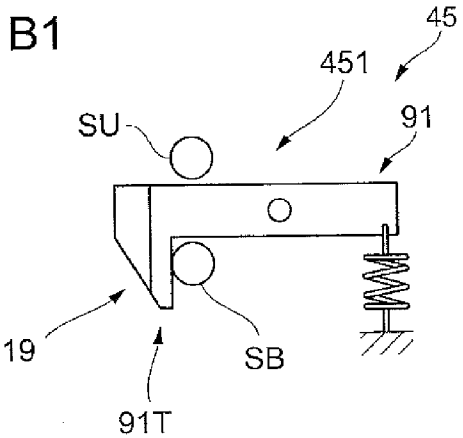
FIG. 11B1

IMAGE FORMING APPARATUS AND DETACHABLE COMPONENT

CROSS-REFERENCE TO RELATED APPLICATIONS

This application is based on and claims priority under 35 USC 119 from Japanese Patent Application No. 2015-146799 filed Jul. 24, 2015.

BACKGROUND

Technical Field

The present invention relates to an image forming apparatus and a detachable component.

SUMMARY

According to an aspect of the present invention, an image forming apparatus includes an apparatus body, a detachable component attachable to and detachable from the apparatus body, a secured part that is provided in the detachable component and that is secured to a predetermined securing position on an apparatus body side, and a regulating part that is provided on the apparatus body side and that regulates a movement of the secured part secured to the securing position. During attachment of the detachable component to the apparatus body, the secured part is brought into contact with the regulating part so as to be displaced or set in a state changed from a state before the contact of the secured part with the regulating part, and the secured part that is displaced or set in the changed state becomes able to pass the regulating part so as to reach the securing position.

BRIEF DESCRIPTION OF THE DRAWINGS

Exemplary embodiments of the present invention will be described in detail based on the following figures, wherein:

FIGS. 7A1 to 7B2 illustrate movements of components during the attachment of the fixing device to the apparatus body;

FIGS. 9A1 to 9D2 illustrate movements of components during the attachment of the fixing device to the apparatus body;

FIGS. 11A1 to 11B2 illustrate movements of components during the attachment of the fixing device to the apparatus body.

DETAILED DESCRIPTION

Exemplary embodiments of the present invention will be described in detail below with reference to the attached drawings.

Figure 1:
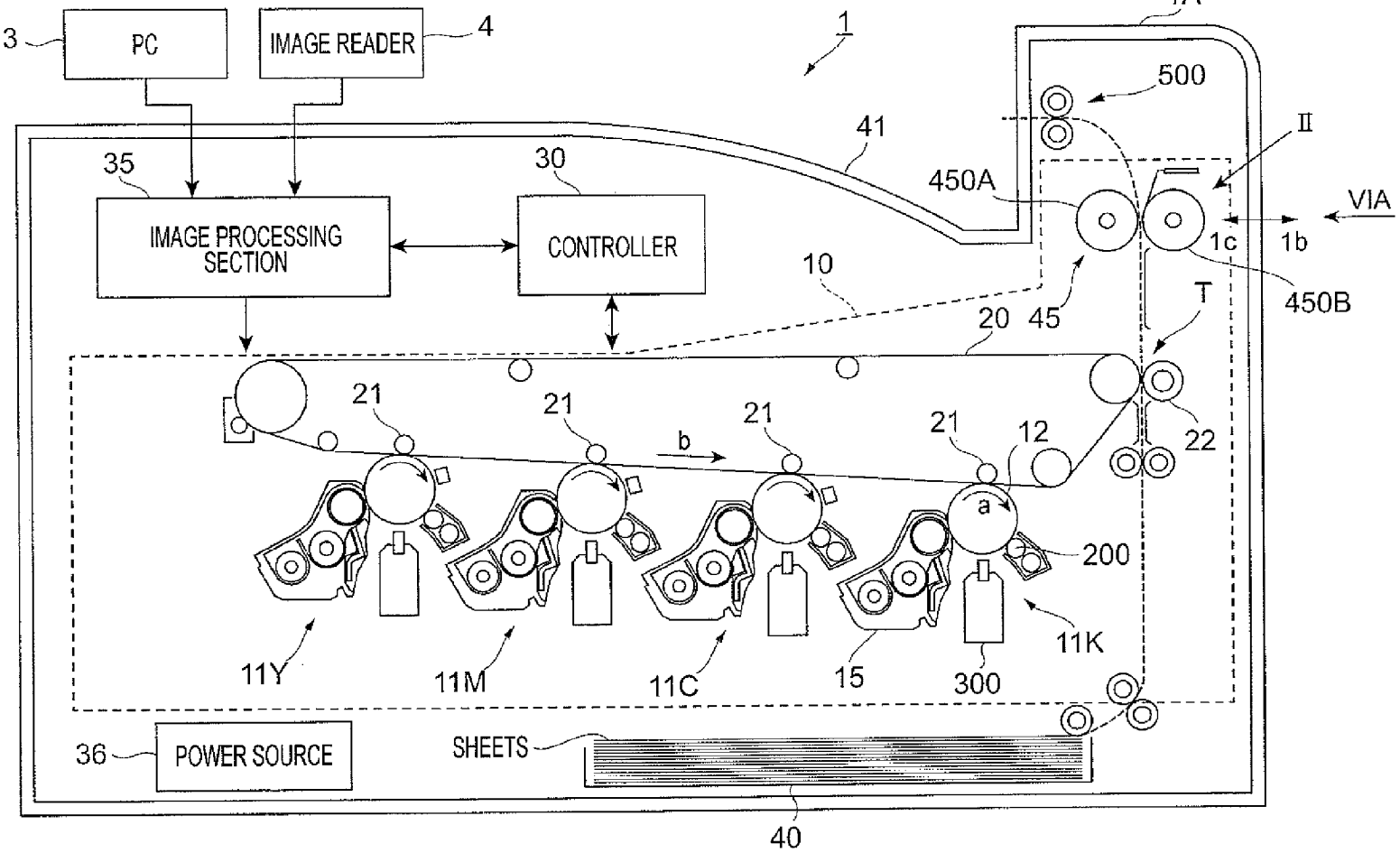
FIG. 1 illustrates an overall structure of an image forming apparatus according to a first exemplary embodiment seen from the front side.

FIG. 1 illustrates an overall structure of an image forming apparatus 1 according to a first exemplary embodiment seen from the front side.

The image forming apparatus 1 is a so-called tandem-type color printer. The image forming apparatus 1 includes an image forming section 10 that forms images on sheets of paper. Each of the sheets serves as an example of a recording medium. The image forming section 10 forms images on the sheet in accordance with image data of colors.

The image forming apparatus 1 also includes a controller 30 that entirely controls operations of the image forming apparatus 1. The image forming apparatus 1 also includes an image processing section 35.

The image processing section 35 performs image processing on the image data transmitted from a personal computer (PC) 3, an image reader 4, and so forth. The image forming apparatus 1 also includes a power source 36 that supplies power to components of the image forming apparatus 1.

The image forming section 10 includes four image forming units 11Y, 11M, 11C, and 11K (may also be generally referred to as "image forming units 11" hereafter) which are parallel to one another and spaced apart from one another by a certain distance.

The image forming units 11 have the same or similar structure except for toner contained in developing devices 15 (which will be described later). Each of the image forming units 11 forms a corresponding one of yellow (Y), magenta (M), cyan (C), and black (K) toner images.

Each of the image forming units 11 includes a photosensitive drum 12, a charger 200, and a light-emitting-diode print head (LPH) 300. The charger 200 charges the photosensitive drum 12. The LPH 300 radiates light to the photosensitive drum 12.

The photosensitive drum 12 is charged by the charger 200. Furthermore, the photosensitive drum 12 is exposed to the light from the LPH 300. Thus, an electrostatic latent image is formed on the photosensitive drum 12.

Furthermore, the image forming unit 11 includes a cleaner (not illustrated) and a developing device 15. The cleaner cleans the surface of the photosensitive drum 12. The developing device 15 develops the electrostatic latent image formed on the photosensitive drum 12.

Furthermore, the image forming section 10 includes an intermediate transfer belt 20, first transfer rollers 21, a second transfer roller 22, and a fixing device 45. The toner images of the colors formed on the photosensitive drums 12 are transferred onto the intermediate transfer belt 20 so as to be superposed on one another. The first transfer rollers 21 sequentially transfer (first transfer) the toner images of the colors formed on the respective photosensitive drums 12 onto the intermediate transfer belt 20. The second transfer roller 22 collectively transfers (second transfer) the toner images having been transferred onto the intermediate transfer belt 20 onto the sheet. The fixing device 45 fixes the images having been transferred through the second transfer to the sheet.

The fixing device 45 includes a fixing roller 450A and a pressure roller 450B. The fixing roller 450A includes a heat source (not illustrated). The pressure roller 450B is pressed against the fixing roller 450A.

According to the present exemplary embodiment, the sheet bearing the toner images is nipped between the fixing roller 450A and the pressure roller 450B so that pressure and heat is applied to this sheet. Thus, the toner images are fixed onto the sheet.

Furthermore, the fixing device 45 is detachably attachable to an apparatus body 1A of the image forming apparatus 1. Here, the fixing device 45 is recognizable as a detachable component detachably attachable to the apparatus body 1A.

The fixing device 45 is detached from the apparatus body 1A by moving the fixing device 45 in a direction indicated by an arrow 1*b* in FIG. 1. The fixing device 45 is attached to the apparatus body 1A by moving the fixing device 45 in a direction indicated by an arrow 1*c* in FIG. 1.

In the image forming apparatus 1, image data from the PC 3 and the image reader 4 is subjected to the image processing performed by the image processing section 35 and supplied to each of the image forming units 11 through an interface (not illustrated). For example, in the image forming unit 11K for black (K), the photosensitive drum 12 is charged by the charger 200 while being rotated in an arrow a direction and exposed to the light from the LPH 300 that emits the light in accordance with the image data transmitted from the image processing section 35.

Thus, an electrostatic latent image related to black (K) is formed on the photosensitive drum 12. The electrostatic latent image formed on the photosensitive drum 12 is developed by the developing device 15 so as to form a black (K) toner image on the photosensitive drum 12.

Likewise, yellow (Y), magenta (M), and cyan (C) toner images are formed in the respective image forming units 11Y, 11M, and 11C.

The toner images of the colors formed by the image forming units 11 are sequentially electrostatically attracted by using the first transfer rollers 21 onto the intermediate transfer belt 20 moving in an arrow b direction. Thus, the toner images are formed by superposing toners of the colors on one another.

As the intermediate transfer belt 20 is moved, this toner images on the intermediate transfer belt 20 are transported to a region (second transfer portion T) where the second transfer roller 22 is disposed.

When the toner images are transferred to the second transfer portion T, the sheet is supplied from a sheet holding section 40 to the second transfer portion T at timing adjusted to timing at which the toner images are transported to the second transfer portion T.

The toner images on the intermediate transfer belt 20 are collectively electrostatically transferred onto the transported sheet by a transfer electric field formed by the second transfer roller 22 in the second transfer portion T.

After that, the sheet onto which the toner images have been electrostatically transferred is removed from the intermediate transfer belt 20 and transported to the fixing device 45. The toner images on the sheet having been transported to the fixing device 45 is subjected to a fixing process in which heat and pressure are applied to the sheet performed by the fixing device 45, thereby being fixed onto the sheet.

The sheet having undergone the fixing process is transported to a sheet stack section 41 by an output roller 500.

Figure 2:
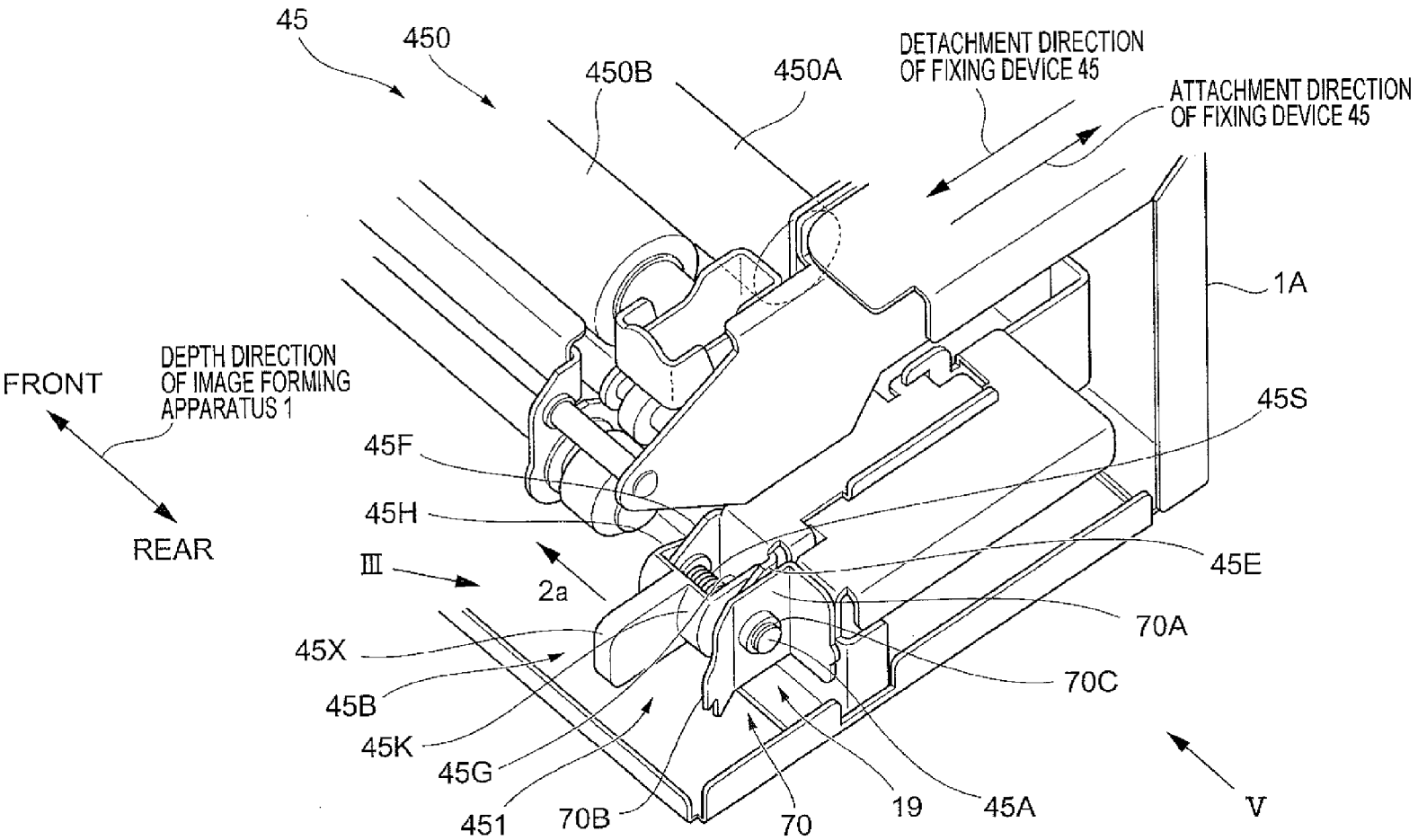
FIG. 2 illustrates a fixing device seen from the rear side of the image forming apparatus in an arrow II direction of FIG. 1.

FIG. 2 illustrates the fixing device 45 seen from the rear side of the image forming apparatus 1 in an arrow II direction of FIG. 1.

As illustrated in FIG. 2, the fixing device 45 includes a fixing device body 450 and a secured part 451. The fixing device body 450 serves as an example of a detachable component body. The secured part 451 is secured to a securing position 19 predetermined on the apparatus body 1A side of the image forming apparatus 1. The fixing device body 450 includes components such as the fixing roller 450A, the pressure roller 450B, and a housing (not illustrated) that supports these rollers.

A guide member 70 is provided at the securing position 19 on the apparatus body 1A side of the image forming apparatus 1. The guide member 70 guides the fixing device 45 to be attached to the apparatus body 1A.

The guide member 70 includes a downstream guide 70A and an upstream guide 70B. The downstream guide 70A is positioned on a downstream side in an attachment direction in which the fixing device 45 is attached. The upstream guide 70B is positioned upstream of the downstream guide 70A.

The downstream guide 70A extends in the attachment direction of the fixing device 45.

The upstream guide 70B is inclined relative to the attachment direction of the fixing device 45 such that the upstream guide 703 gradually approaches the fixing device 45 side toward the downstream side in the attachment direction.

Furthermore, a through hole 70C is formed in the downstream guide 70A according to the present exemplary embodiment.

A pin 45A is provided in the secured part 451 of the fixing device 45. The pin 45A is inserted through the through hole 70C of the downstream guide 70A. This pin 45A extends in a direction perpendicular to (intersecting) the attachment direction of the fixing device 45.

According to the present exemplary embodiment, the fixing device 45 is secured to the apparatus body 1A by inserting the pin 45A through the through hole 70C on the apparatus body 1A side.

Furthermore, an operation member 45B to be operated by an operator is provided in the secured part 451.

The pin 45A is secured to this operation member 45B. When the operator moves the operation member 45B in a direction indicated by an arrow 2*a* in FIG. 2, the pin 45A is removed from the through hole 70C. This releases the securing of the secured part 451 to the apparatus body 1A. Thus, the fixing device 45 becomes detachable from the apparatus body 1A.

The secured part 451 also includes a coil spring 45S that urges the operation member 45B and the pin 45A toward a side where the through hole 70C is provided.

Two of the secured part 451 including the pin 45A, the operation member 456, and the coil spring 45S are provided. One of the secured parts 451 is disposed on the rear side of the image forming apparatus 1 and the other secured part 451 is disposed on the front side of the image forming apparatus 1.

Furthermore, each of the secured parts 451 of the fixing device 45 includes a first support plate 45E and a second support plate 45F that support the pin 45A, the operation member 45B, and the coil spring 45S.

The first support plate 45E and the second support plate 45F extend in an attachment and detachment direction of the fixing device 45.

Furthermore, the first support plate 45E and the second support plate 45F are disposed at positions different from each other in a direction perpendicular to the attachment and detachment direction of the fixing device 45.

Furthermore, a gap is provided between the first support plate 45E and the second support plate 45F. The first support plate 45E is positioned on the rear side of the image forming apparatus 1, and the second support plate 45F is positioned on the front side of the image forming apparatus 1.

The operation member 45B includes a base portion 45K that extends in a depth direction (direction perpendicular to the attachment and detachment direction of the fixing device 45) of the image forming apparatus 1. Furthermore, a first projecting plate 45G and a second projecting plate 45H project from the base portion 45K and extend to the downstream side in the attachment direction of the fixing device 45.

The first projecting plate 45G is positioned between the first support plate 45E and the second support plate 45F. The second projecting plate 45H faces an outer surface of the second support plate 45F.

According to the present exemplary embodiment, a base of the pin 45A is supported by the second projecting plate 45H. Furthermore, the first projecting plate 45G, the first support plate 45E, and the second support plate 45F have respective through holes through which the pin 45A is inserted.

Furthermore, according to the present exemplary embodiment, the coil spring 45S is disposed between the first projecting plate 45G and the second support plate 45F, thereby the first projecting plate 45G is pressed by the coil spring 45S.

Thus, the pin 45A is urged toward the through hole 70C formed in the downstream guide 70A.

The operation member 45B also includes an operated portion 45X to be operated by the operator. The operated portion 45X projects from an outer surface of the base portion 45K.

Furthermore, the operated portion 45X projects in an opposite direction to a projecting direction of the first projecting plate 45G and the second projecting plate 45H. The operated portion 45X extends in the attachment and detachment direction of the fixing device 45.

Furthermore, according to the present exemplary embodiment, a torsion spring (not illustrated) that rotates the operation member 45B about the pin 45A as a rotational shaft is provided. With this torsion spring, according to the present exemplary embodiment, the operation member 45B is rotated and the operated portion 45X is rotated downward (the details will be described later).

According to the present exemplary embodiment, the operation member 45B is rotated by the torsion spring provided separately from the coil spring 45S. However, a torsion spring may be used as the coil spring 45S so that the operation member 45B is rotated by the coil spring 45S.

Alternatively, for example, the operation member 45B may be rotated by utilizing the gravity acting on the operated portion 45X (by utilizing the weight of the operated portion 45X).

In order to detach the fixing device 45 from the apparatus body 1A, the operated portion 45X that has been rotated downward is moved upward by the operator (the details will be described later). After that, the operated portion 45X is pressed in the direction indicated by the arrow 2*a* (front side of the image forming apparatus 1) in FIG. 2.

Thus, the pin 45A is removed from the through hole 70C. This releases the securing of the secured part 451 to the apparatus body 1A. Next, the fixing device 45 is drawn in a detachment direction. Thus, the fixing device 45 is detached from the apparatus body 1A.

Figure 3A:
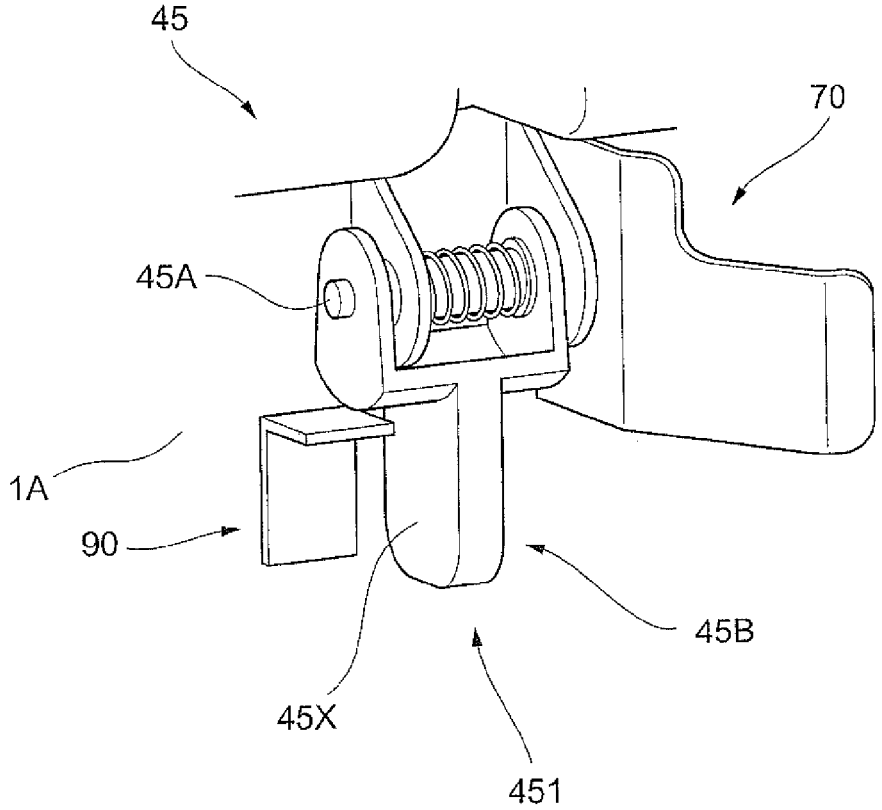
FIGS. 3A and 3B illustrate components such as a secured part and a guide member seen in an arrow III direction of FIG. 2.
Figure 3B:
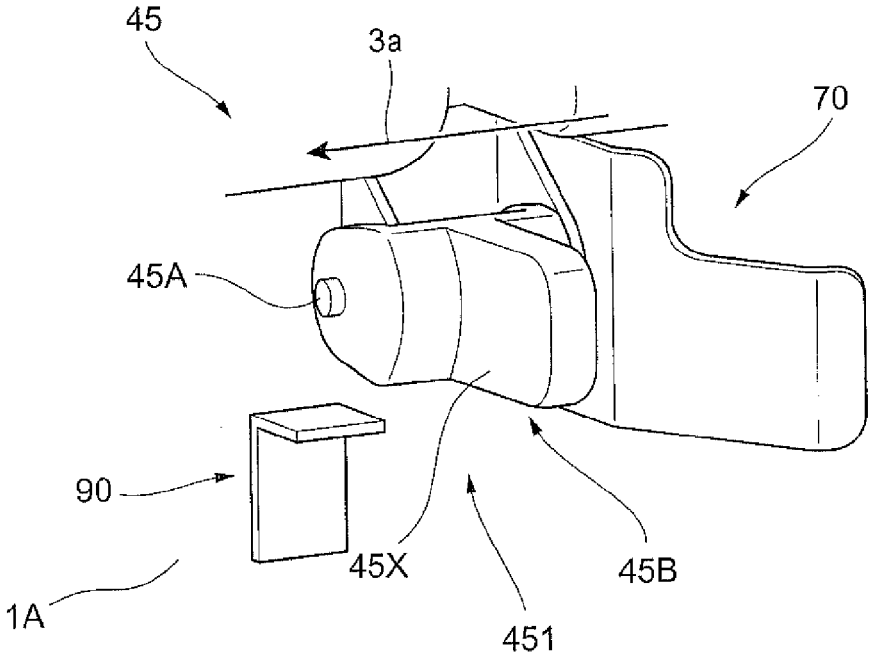

FIGS. 3A and 3B illustrate components such as the secured part 451 and the guide member 70 seen in an arrow III direction of FIG. 2. In FIG. 3A, the operated portion 45X has been rotated downward.

Although it is omitted from the above description, as illustrated in FIG. 3A, a regulating member 90 that functions as a regulating part that regulates a movement of the secured part 451 is provided on the apparatus body 1A side according to the present exemplary embodiment. The regulating member 90 is formed of an L-shaped sheet metal.

The regulating member 90 is positioned in a movement path of the secured part 451 for detachment of the fixing device 45 from the apparatus body 1A and regulates the movement of the secured part 451. Thus, release of the securing of the fixing device 45 is suppressed.

More specifically, as illustrated in FIG. 3A, the regulating member 90 is positioned on the left side of the secured part 451 in FIG. 3A. Thus, the secured part 451 abuts the regulating member 90 even when a leftward movement of the secured part 451 in FIG. 3A is attempted.

This prevents the pin 45A from being removed from the through hole 70C (see FIG. 2). Thus, the release of the securing of the fixing device 45 is suppressed.

Here, when the fixing device 45 has a structure that allows the securing of the fixing device 45 to be easily released, the securing is released by an operating error by the operator or the like.

In such a case, the fixing device 45 may be disposed at a position sifted from the position intended by the design. This may lead to, for example, paper jam or degradation of fixing performance. In contrast, according to the present exemplary embodiment, the securing of the fixing device 45 is not easily released. Thus, the release of the securing not intended by the operator may be suppressed.

In order to release the securing, as illustrated in FIG. 3B, the operated portion 45X is rotated upward in FIG. 3E so as to rotate the secured part 451.

Next, as indicated by an arrow 3*a*, the operated portion 45X is pressed leftward in FIG. 3B. Thus, the pin 45A is removed from the through hole 70C (see FIG. 2), and accordingly, the fixing device 45 is able to be detached from the apparatus body 1A.

Figure 4A:
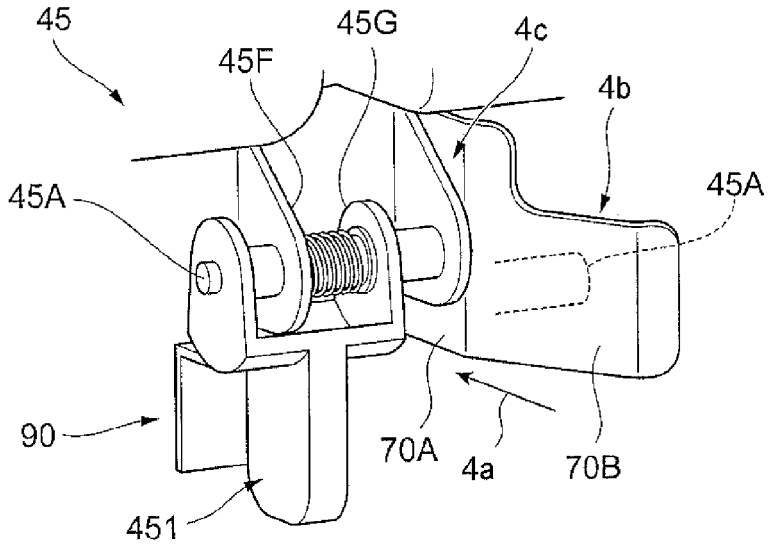
FIGS. 4A to 4C illustrate movements of the components during attachment of the fixing device to an apparatus body.
Figure 4B:
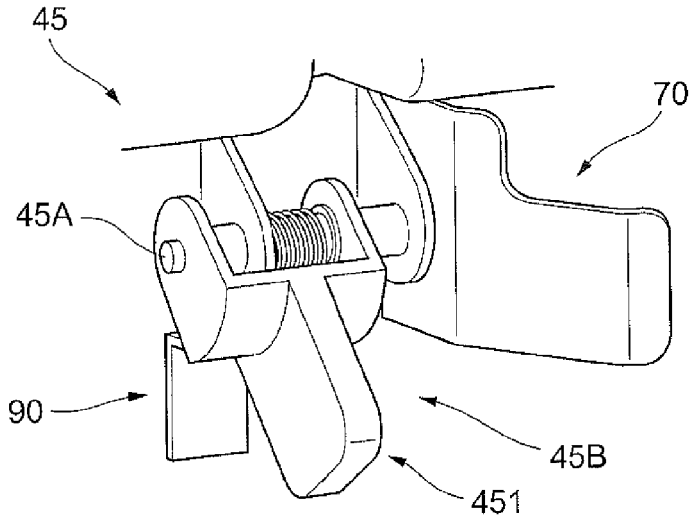
Figure 4C:
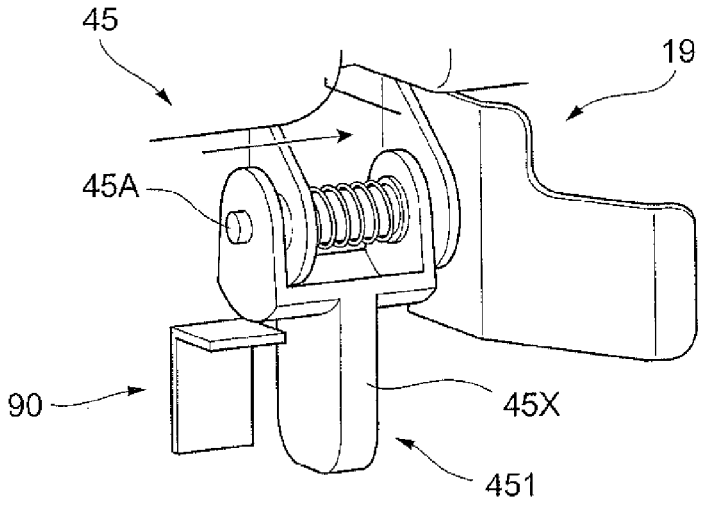

FIGS. 4A to 4C illustrate movements of the components during attachment of the fixing device 45 to the apparatus body 1A.

In order to attach the fixing device 45 to the apparatus body 1A, the secured part 451 is initially moved along a linear movement path denoted by reference numeral 4*a* of FIG. 4A. Then, as denoted by reference numeral 4*b* of FIG. 4A, the tip of the pin 45A is brought into contact with the upstream guide 70B. Then, when the fixing device 45 is further pushed into the apparatus body 1A, as denoted by reference numeral 4*c*, the pin 45A reaches the downstream guide 70A.

Then, when the fixing device 45 is further pushed into the apparatus body 1A, the pin 45A is further moved to the downstream side in the attachment direction of the fixing device 45 while being guided by the downstream guide 70A.

Furthermore, when the fixing device 45 is still further pushed into the apparatus body 1A, as illustrated in FIG. 4B, a portion of the secured part 451 abuts the regulating member 90. This rotates the secured part 451.

More specifically, according to the present exemplary embodiment, the regulating member 90 is positioned in the movement path of the secured part 451. Thus, during attachment of the fixing device 45, the portion of the secured part 451 abuts the regulating member 90. This rotates the secured part 451. Additionally, according to the present exemplary embodiment, when the portion of the secured part 451 is brought into contact with the regulating member 90, a rotation moment acts on the secured part 451, thereby rotating the secured part 451 (state of the secured part 451 is changed).

According to the present exemplary embodiment, this rotation releases the abutment of the portion of the secured part 451 against the regulating member 90. This allows the secured part 451 to pass the regulating member 90, and accordingly, the fixing device 45 may be further pushed into the apparatus body 1A.

In more detail, according to the present exemplary embodiment, the movement path of the secured part 451 for attachment of the fixing device 45 is L-shaped.

Specifically, the movement path of the secured part 451 includes a first path and a second path. The linear first path extends in the attachment and detachment direction of the fixing device 45. The second path is perpendicular to the first path and extends from a side where the regulating member 90 is provided (see FIG. 4B) to a side where the guide member 70 is provided.

According to the present exemplary embodiment, the regulating member 90 is provided in the middle of the L-shaped path (at a position where the first path and the second path intersect each other).

Here, in the case where the secured part 451 is not rotated, the regulating member 90 and the secured part 451 interfere with each other, thereby stopping the secured part 451 in the middle of the movement path. In this case, the fixing device 45 is not easily attached.

When the secured part 451 has passed the regulating member 90, the secured part 451 passes the second path and is moved toward the guide member 70.

More specifically, when the secured part 451 has passed the regulating member 90, the pin 45A and the operation member 45B (see FIG. 4B) urged by the coil spring 45S (see FIG. 2) are moved toward the guide member 70 (see FIG. 4B). Thus, the pin 45A is inserted into the through hole 70C (see FIG. 2).

Furthermore, according to the present exemplary embodiment, when the secured part 451 passes the regulating member 90, the secured part 451 is rotated, and the operated portion 45X is rotated downward as illustrated FIG. 4C. Thus, the operated portion 45X is positioned on the right side of the regulating member 90. In this case, as has been described, the release of the securing of the secured part 451 due to an operating error is unlikely to occur.

In order to release the securing of the secured part 451, the operated portion 45X in a state illustrated in FIG. 4C is rotated upward, and then the secured part 451 is moved leftward in FIG. 4C.

Here, according to the present exemplary embodiment, the secured part 451 may be positioned on the right side of the regulating member 90 (a regulated position where the movement is regulated by the regulating member 90) without a particular operation performed by the operator.

Additionally, the secured part 451 may be positioned on the right side of the regulating member 90 only by attaching the fixing device 45 to the apparatus body 1A.

Furthermore, according to the present exemplary embodiment, when attachment of the fixing device 45 is incomplete, an exterior covering is unable to be closed.

Figure 5:
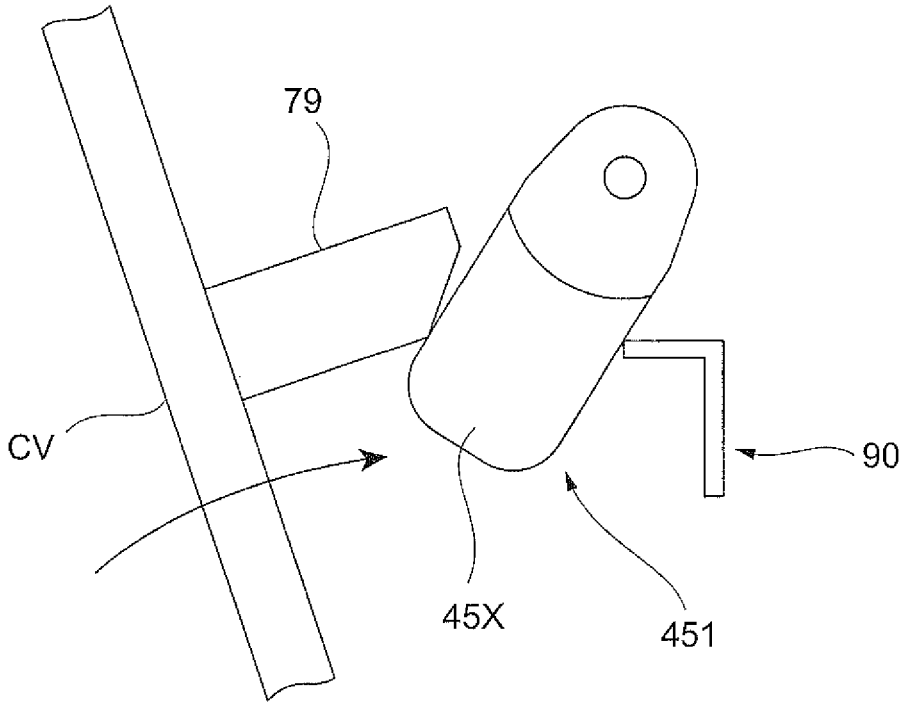
FIG. 5 illustrates the fixing device, a regulating member, and an exterior covering seen in an arrow V direction of FIG. 2.

FIG. 5 illustrates the fixing device 45, the regulating member 90, and an exterior covering CV seen in an arrow V direction of FIG. 2.

Although it is omitted from the above description, according to the present exemplary embodiment, an exterior covering CV is provided. The exterior covering CV is able to be opened and closed relative to the apparatus body 1A (see FIG. 1) and functions as a covering member that covers a portion of the apparatus body 1A. According to the present exemplary embodiment, this exterior covering CV is opened and closed when the fixing device 45 is attached to or detached from the apparatus body 1A.

Here, the exterior covering CV includes a projection 79 that projects from an inner surface of the exterior covering CV.

According to the present exemplary embodiment, in the case where the secured part 451 of the fixing device 45 does not reach the securing position 19 (see FIG. 2) and remains upstream of the regulating member 90 in the attachment direction of the fixing device 45 as illustrated in FIG. 5 (remains at a predetermined position) after an attachment operation of the fixing device 45 has been performed, the secured part 451 is in contact with the regulating member 90. Furthermore, the secured part 451 is pressed by the regulating member 90, thereby a portion of the secured part 451 (operated portion 45X) projects in a movement path of the exterior covering CV.

Thus, when the exterior covering CV is closed in a state in which the secured part 451 remains upstream of the regulating member 90 in the attachment direction of the fixing device 45 (in a state in which the attachment of the fixing device 45 is incomplete), the portion of the secured part 451 and the exterior covering CV interfere with each other. Thus, the exterior covering CV is unable to be closed.

According to the present invention, since the exterior covering CV is unable to be closed, the operator may easily recognize that the attachment of the fixing device 45 is incomplete.

Figure 6C:
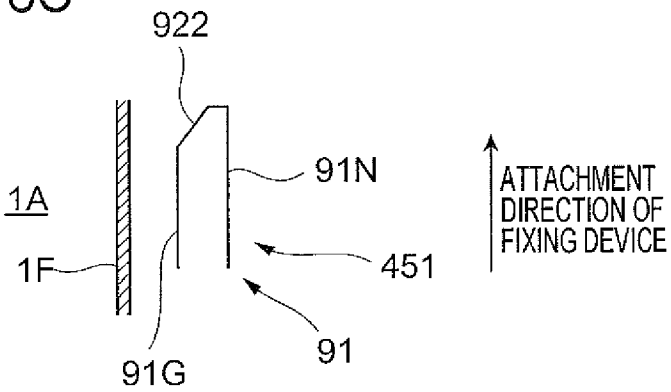
FIGS. 6A to 6C illustrate a fixing device and an apparatus body according to a second exemplary embodiment.
Figure 6A:
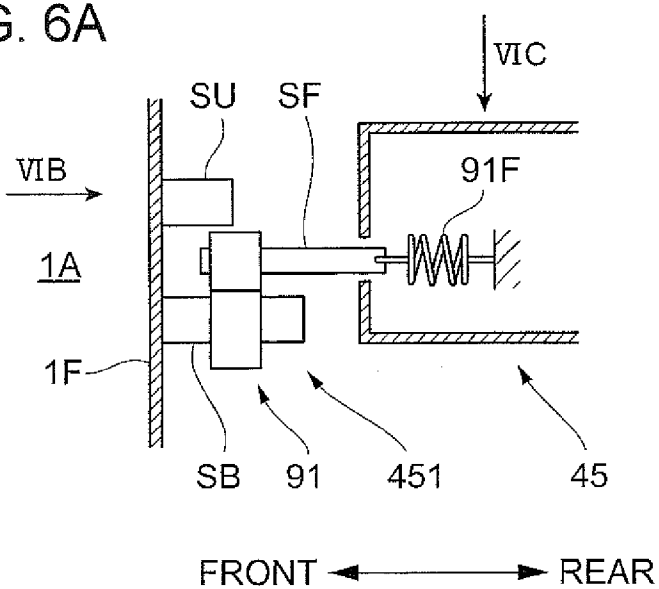
Figure 6B:
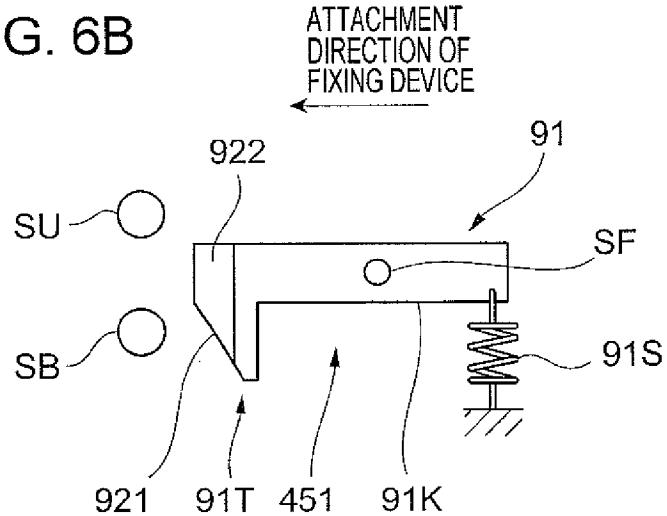

FIGS. 6A to 6C illustrate the fixing device 45 and the apparatus body 1A according to a second exemplary embodiment. FIG. 6A illustrates the fixing device 45 and the apparatus body 1A seen in an arrow VIA direction of FIG. 1. Portions of the fixing device 45 and the apparatus body 1A illustrated in FIG. 6A are those on the front side of the image forming apparatus 1. FIG. 6B illustrates the fixing device 45 and the apparatus body 1A seen in an arrow VIB direction of FIG. 6A. FIG. 6C illustrates the secured part 451 of the fixing device 45 and the apparatus body 1A seen in an arrow VIC direction of FIG. 6A.

As illustrated in FIG. 6B, according to the second exemplary embodiment, the secured part 451 includes a hook-shaped hook member 91 that is hooked to the apparatus body 1A.

The hook member 91 includes a bar-shaped base portion 91K and a projection 91T that projects downward from the base portion 91K.

Furthermore, as illustrated in FIG. 6B, a portion of the hook member 91 which is the projection 91T and a tip portion of the hook member 91 has a first inclined surface 921 that rises toward the downstream side in the attachment direction of the fixing device 45.

Furthermore, as illustrated in FIGS. 6B and 6C, a second inclined surface 922 is formed at the tip portion of the hook member 91. As illustrated in FIG. 6C, the second inclined surface 922 is inclined from an outer surface 91G side of the hook member 91 to an inner surface 91N side of the hook member 91 toward the downstream side in the attachment direction of the fixing device 45.

Furthermore, according to the present exemplary embodiment, as illustrated in FIG. 6B, the hook member 91 is rotatable about a shaft SF. Furthermore, as illustrated in FIG. 6B, a pressure spring 91S that presses the hook member 91 upward is provided at a position on the right side of the shaft SF in FIG. 6B and below the hook member 91. Thus, according to the present exemplary embodiment, the projection 91T is urged downward.

Furthermore, as illustrated in FIG. 6A, an urging spring 91F that urges the hook member 91 to the apparatus body 1A side (left side in FIG. 6A) is provided in the fixing device 45.

The urging spring 91F presses the shaft SF, thereby urging the hook member 91 leftward in FIG. 6A.

As illustrated in FIG. 6A, an apparatus frame 1F that extends in the attachment and detachment direction of the fixing device 45 is provided on the apparatus body 1A side.

Furthermore, as illustrated in FIGS. 6A and 6B, an upper shaft SU and a lower shaft SB are provided on the apparatus body 1A side. The upper shaft SU projects to the fixing device 45 side. The lower shaft SB is disposed below this upper shaft SU.

FIGS. 7A1 to 732 illustrate movements of the components during the attachment of the fixing device 45 to the apparatus body 1A.

When the attachment of the fixing device 45 is started and the fixing device 45 reaches a predetermined position of the apparatus body 1A, the first inclined surface 921 of the hook member 91 abuts the lower shaft SB as illustrated in FIG. 7A1. This rotates the hook member 91 clockwise as indicated in an arrow 7*a*.

Thus, as illustrated in FIG. 7A1, the second inclined surface 922 of the hook member 91 is moved to a position facing a distal end of the upper shaft SU.

When the fixing device 45 is further pushed into the apparatus body 1A, the second inclined surface 922 is brought into contact with the distal end of the upper shaft SU, thereby the second inclined surface 922 is pressed by the upper shaft SU. Thus, as indicated by an arrow 7*b* of FIG. 7A2, the hook member 91 is moved rightward in FIG. 7A2.

Thus, the hook member 91 is able to pass the upper shaft SU.

Here, according to the present exemplary embodiment, the hook member 91 is moved along an L-shaped path. Specifically, the hook member 91 is moved along a linear path denoted by reference numeral 7*c* of FIG. 7A2 (path along an attachment and detachment path of the fixing device 45), and then moved along a downward path denoted by reference numeral 7*d*.

According to the present exemplary embodiment, the upper shaft SU is positioned in this L-shaped path, and when the attachment of the fixing device 45 is performed, the hook member 91 is brought into contact with the upper shaft SU and passes the upper shaft SU.

When the hook member 91 passes the upper shaft SU, the hook member 91 is rotated about the shaft SF. Specifically, the hook member 91 according to the present exemplary embodiment is urged (given a rotational force) by the pressure spring 91S (see FIG. 6B), and when the hook member 91 passes the upper shaft SU, the hook member 91 is rotated such that the projection 91T (see FIG. 69) is moved downward. Thus, as illustrated in FIG. 7B2, the projection 91T is positioned at a position where the projection 91T is hooked onto the lower shaft SB.

After that, according to the present exemplary embodiment, as illustrated in FIG. 7B2, the hook member 91 is pressed by the urging spring 91F so as to be moved toward the apparatus frame 1F of the apparatus body 1A. Thus, as illustrated in FIGS. 7B1 and 7B2, the upper shaft SU is positioned above the hook member 91.

Additionally, according to the present exemplary embodiment, the hook member 91 is pressed by the urging spring 91F so as to be moved toward the apparatus frame 1F of the apparatus body 1A, thereby the hook member 91 is positioned at a regulated position where a movement of the hook member 91 is regulated by the upper shaft SU.

In more detail, according to the present exemplary embodiment, the hook member 91 is pressed by the urging spring 91F so as to be moved toward the apparatus frame 1F of the apparatus body 1A, thereby the hook member 91 is positioned at the securing position 19 (see FIG. 7B1).

In more detail, according to the present exemplary embodiment, during the attachment of the fixing device 45 to the apparatus body 1A, the hook member 91 is moved in one direction (attachment and detachment direction of the fixing device 45) and brought into contact with the upper shaft SU that functions as the regulating part.

According to the present exemplary embodiment, the second inclined surface 922 (see FIG. 7A1) inclined relative to this one direction is formed in the hook member 91 and brought into contact with the distal end of the upper shaft SU.

This moves the hook member 91 in a direction intersecting the above-described one direction, thereby the hook member 91 is able to pass the upper shaft SU.

Although the inclined surfaces are provided on the hook member 91 side according to the present exemplary embodiment, the inclined surfaces may be provided at the distal end of the upper shaft SU. Furthermore, the inclined surfaces are provided to each of the distal end of the upper shaft SU and the hook member 91.

Also according to the present exemplary embodiment, the release of the securing not intended by the operator may be suppressed.

According to the present exemplary embodiment, the movement of the hook member 91 is regulated by the upper shaft SU that functions as the regulating part only by moving the hook member 91 upward. Accordingly, even when the hook member 91 is moved upward due to, for example, an operational error by the operator, the securing is not released.

In order to release the securing according to the present exemplary embodiment, the hook member 91 is moved in a direction opposite to a direction indicated by an arrow 7*e* of FIG. 7B2. Then, the hook member 91 is moved upward.

Figure 8B:
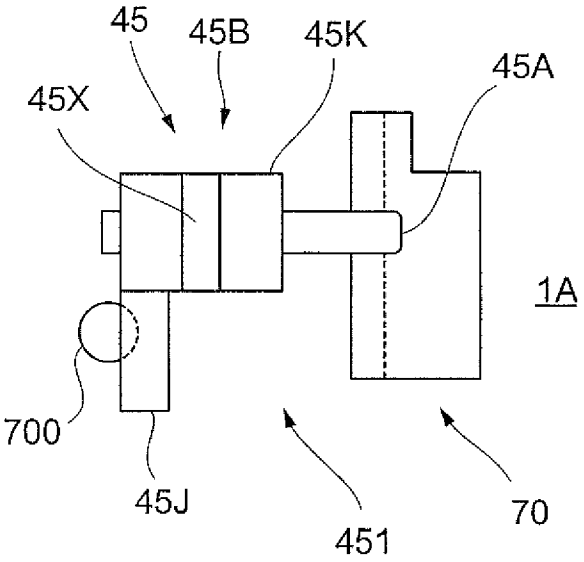
FIGS. 8A and 8B illustrate a fixing device and an apparatus body according to a third exemplary embodiment.
Figure 8A:
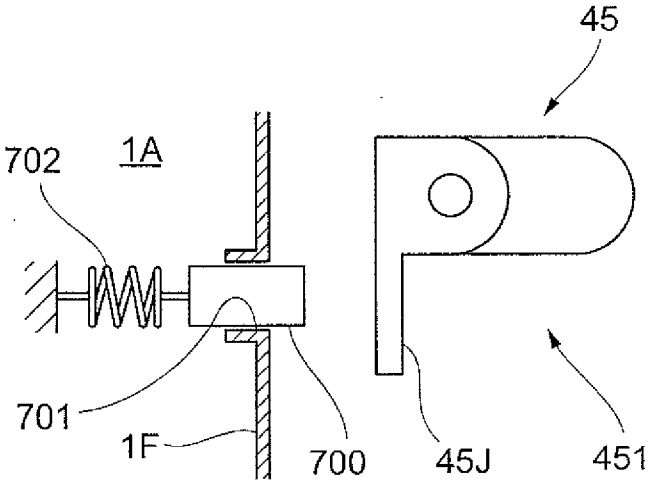

FIGS. 8A and 8B illustrate the fixing device 45 and the apparatus body 1A according to a third exemplary embodiment. Elements having the functions that are the same as or similar to those of the elements according to the above-described exemplary embodiments are denoted by the same reference numerals and description thereof is omitted.

As illustrated in FIG. 8B and similarly to the first exemplary embodiment, the operation member 45B to be operated by the operator and the pin 45A moved together with the operation member 45B are provided in the secured part 451 of the fixing device 45. Furthermore, a projection 45J that projects downward from the base portion 45K is provided in the operation member 45B.

Meanwhile, on the apparatus body 1A side, similarly to the first exemplary embodiment and as illustrated in FIG. 8B, the guide member 70 is provided.

Furthermore, as illustrated in FIG. 8A, a projecting member 700 that projects in the movement path of the secured part 451 (projection 45J) is provided on the apparatus body 1A side.

The apparatus frame 1F is also provided on the apparatus body 1A side. The apparatus frame 1F has a through hole 701 through which the projecting member 700 is inserted. Furthermore, an urging spring 702 that causes the projecting member 700 to project in the movement path of the secured part 451 is provided.

FIGS. 9A1 to 9D2 illustrate movements of the components during the attachment of the fixing device 45 to the apparatus body 1A.

When the attachment of the fixing device 45 to the apparatus body 1A is started, as has been described and as illustrated in FIG. 9A2, the pin 45A abuts the upstream guide 70B. Thus, as indicated by an arrow 9*a*, the secured part 451 is moved leftward in FIG. 9A2.

Furthermore, when the fixing device 45 is further pushed into the apparatus body 1A, as illustrated in FIGS. 9B1 and 9B2, the secured part 451 abuts the projecting member 700. More specifically, the projection 45J abuts the projecting member 700.

This retracts the projecting member 700 to a rear surface side of the apparatus frame 1F as illustrated in FIGS. 9C1 and 9C2. Here, when the projecting member 700 is not retracted, the movement of the fixing device 45 is regulated, and accordingly, the attachment of the fixing device 45 to the apparatus body 1A becomes difficult.

After that, according to the present exemplary embodiment, as illustrated in FIG. 9D2, the pin 45A is inserted into a through hole (not illustrated) formed in the guide member 70. This causes the fixing device 45 to be secured to the apparatus body 1A. Additionally, the secured part 451 is secured to the predetermined securing position 19.

Furthermore, according to the present exemplary embodiment, when the pin 45A is inserted into the through hole, the projecting member 700 is advanced to a side of the secured part 451 as illustrated in FIGS. 9D1 and 9D2.

According to the present exemplary embodiment, when a leftward movement of the secured part 451 in FIG. 9D2 is attempted from a state illustrated in FIG. 9D2, the secured part 451 abuts the projecting member 700 functioning as the regulating part, and accordingly, the movement of the secured part 451 is regulated. Thus, similarly to the above-described embodiments, unintended release of the securing due to an operational error or the like may be suppressed.

More in detail, also according to the present exemplary embodiment, the secured part 451 is moved along an L-shaped movement path. The projecting member 700 that regulates the movement of the secured part 451 is positioned in this movement path. Furthermore, according to the present exemplary embodiment, the projecting member 700 positioned in the movement path is pressed by the secured part 451 having been moved in the movement path. Thus, the projecting member 700 is temporarily retracted from the movement path. This allows the secured part 451 to pass the projecting member 700, and accordingly, the secured part 451 reaches the securing position 19 (see FIG. 9D2).

When the secured part 451 has passed the projecting member 700, this projecting member 700 is returned into the movement path of the secured part 451. Thus, the movement of the secured part 451 is regulated, and accordingly, unintended release of the securing due to an operational error or the like may be suppressed.

Additionally, also according to the present exemplary embodiment, when the fixing device 45 is attached, the secured part 451 reaches the regulated position where the projecting member 700 regulates the movement. Thus, the movement of the secured part 451 is regulated by the projecting member 700.

In more detail, according to the present exemplary embodiment, the movement path of the secured part 451 is L-shaped, that is, bent in the middle. During the attachment of the fixing device 45 to the apparatus body 1A, the secured part 451 is moved in one direction (moved in a direction indicated by an arrow 9*x* in FIG. 9C1), reaches a predetermined position (position denoted by reference numeral 9*b* in FIG. 9C1), and then is moved in a direction perpendicular to (intersecting) the one direction (direction indicated by reference sign 9*c* and perpendicular to the page of FIGS. 9A1 to 9D2).

The projecting member 700 is disposed at the predetermined position (position denoted by reference numeral 9*b*).

The projecting member 700 is pressed by the secured part 451 having been moved in the one direction and reached this predetermined position, thereby the projecting member 700 is moved to the downstream side in this one direction. Additionally, the projecting member 700 is moved in a direction indicated by an arrow 9*d* in FIG. 9C1.

Thus, the projecting member 700 is retracted from the movement path of the secured part 451, and accordingly, the secured part 451 is able to pass the projecting member 700.

In order to release the securing of the secured part 451, the secured part 451 is moved leftward in FIG. 9D2 while the projecting member 700 illustrated in FIG. 9D2 is pressed to the back side of the page of FIG. 9D2.

Thus, the pin 45A is removed from the through hole (not illustrated), and accordingly, the fixing device 45 becomes detachable from the apparatus body 1A.

Figure 10C:
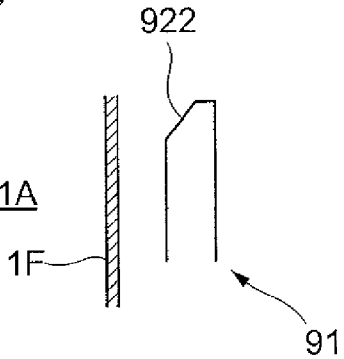
FIGS. 10A to 10C illustrate a fixing device and an apparatus body according to a fourth exemplary embodiment.
Figure 10B:
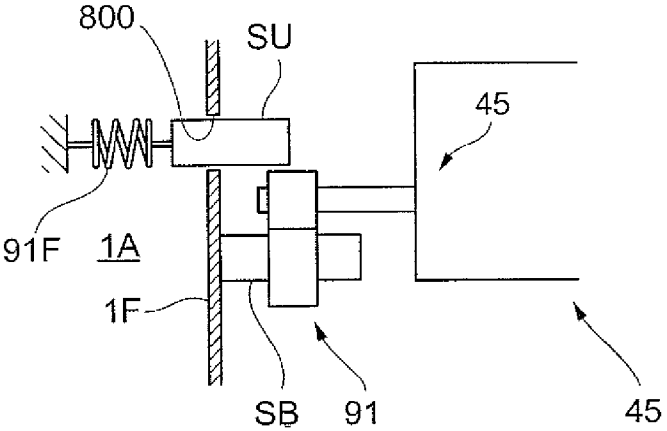
Figure 10A:
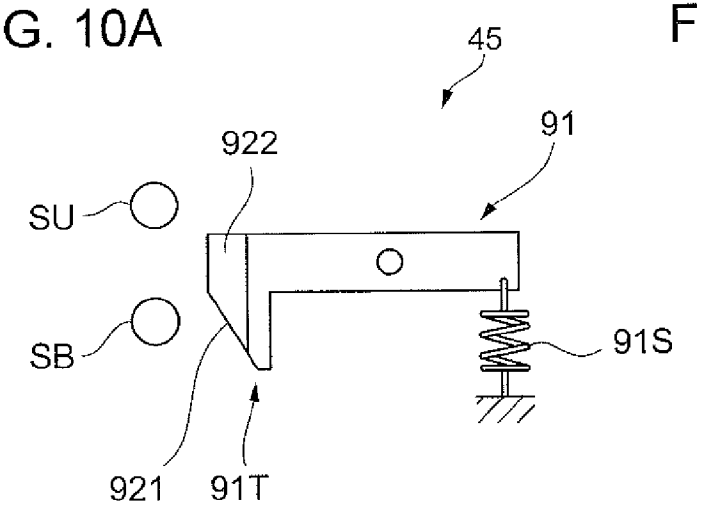

FIGS. 10A to 10C illustrate the fixing device 45 and the apparatus body 1A according to a fourth exemplary embodiment. Elements having the functions that are the same as or similar to those of the elements in the above description are denoted by the same reference numerals and description thereof is omitted.

According to the present exemplary embodiment, the apparatus frame 1F is provided as illustrated in FIG. 10B and similarly to that according to the second exemplary embodiment illustrated in FIGS. 6A and 6C. The apparatus frame 1F has a through hole 800 through which the upper shaft SU is advanced and retracted.

Furthermore, the urging spring 91F that urges the upper shaft SU to the fixing device 45 side is provided.

According to the second exemplary embodiment illustrated in FIGS. 6A to 6C, the hook member 91 is advanced to and retracted away from the fixing device 45. According to this fourth exemplary embodiment, the hook member 91 is not advanced to or retracted away from the fixing device 45.

FIGS. 11A1 to 11B2 illustrate movements of the components during the attachment of the fixing device 45 to the apparatus body 1A.

When the attachment of the fixing device 45 is started and the fixing device 45 reaches a predetermined position of the apparatus body 1A, the first inclined surface 921 formed on a lower surface of the hook member 91 abuts the lower shaft SB as illustrated in FIG. 11A1. As illustrated in FIG. 11A1, this causes the hook member 91 to be rotated clockwise in FIG. 11A1. Thus, the second inclined surface 922 of the hook member 91 is moved to a position facing the distal end of the upper shaft SU.

When the fixing device 45 is further pushed into the apparatus body 1A, the upper shaft SU is pressed by the second inclined surface 922, thereby being moved leftward in FIG. 11A2 as indicated by an arrow 11*a* of FIG. 11A2.

Thus, the upper shaft SU is retracted from the movement path of the hook member 91, and accordingly, the hook member 91 is able to pass the upper shaft SU.

The hook member 91 having passed the upper shaft SU is rotated, and, as illustrated in FIG. 11B1, the projection 91T of the hook member 91 is positioned downstream of the lower shaft SB in the attachment direction of the fixing device 45. Thus, the secured part 451 is positioned at the securing position 19, thereby the fixing device 45 is secured to the apparatus body 1A.

When the secured part 451 is positioned at the securing position 19, as illustrated in FIG. 11B1, the projection 91T is positioned on the left side of the lower shaft SB in FIG. 11B1. In this state, even when a rightward movement of the fixing device 45 in FIG. 11B1 is attempted, the projection 91T is hooked onto the lower shaft SB.

Furthermore, according to the present exemplary embodiment, when the hook member 91 has passed the upper shaft SU and has been rotated, the upper shaft SU is advanced to a space above the hook member 91 as illustrated by an arrow 11*b* of FIG. 11B2.

Thus, also according to the present exemplary embodiment, the securing of the fixing device 45 is not released only by moving the hook member 91 upward, and accordingly, the release of the securing due to an operational error is unlikely to occur.

In order to release the securing according to the present exemplary embodiment, the upper shaft SU is pushed and moved in a direction opposite to a direction indicated by the arrow 11*b* of FIG. 11B2. Then, the hook member 91 is moved upward.

According to the present exemplary embodiment, similarly to the third exemplary embodiment, during the attachment of the fixing device 45 to the apparatus body 1A, the upper shaft SU positioned in the movement path of the securing of the secured part 451 is pressed by the secured part 451 having been moved in the movement path. Thus, the upper shaft SU is temporarily retracted from the movement path.

Thus, the secured part 451 is able to pass the upper shaft SU. When the secured part 451 has passed the upper shaft SU, the secured part 451 reaches the securing position 19, thereby the secured part 451 is secured to the apparatus body 1A side.

Furthermore, when the secured part 451 has passed the upper shaft SU, the upper shaft SU having been retracted from the movement path of the secured part 451 is returned to the movement path of the secured part 451. Thus, the movement of the secured part 451 is regulated by this upper shaft SU, and accordingly, the release of the securing due to an operational error is unlikely to occur.

In more detail, also according to the present exemplary embodiment, during the attachment of the fixing device 45 to the apparatus body 1A, the secured part 451 is moved in one direction and brought into contact with the upper shaft SU that functions as the regulating part. Here, also according to the present exemplary embodiment, the second inclined surface 922 inclined relative to this one direction is formed in the secured part 451 and brought into contact with the distal end of the upper shaft SU. This moves the upper shaft SU in a direction intersecting the one direction. Thus, the secured part 451 is able to pass the upper shaft SU.

The component in which the inclined surfaces are provided is not limited to the secured part 451. The inclined surfaces may be provided on the upper shaft SU side. Furthermore, the inclined surfaces may be provided to each of the secured part 451 and the upper shaft SU.

Other Examples

Although the fixing device 45 is described as an example of the detachable component according to the present exemplary embodiment, the detachable component is not limited to the fixing device 45. Other examples of the detachable component may include, for example, a toner cartridge containing toner. Also, the other examples of the detachable component may include a drum unit which is a unit including a photosensitive drum.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body;

a detachable component attachable to and detachable from the apparatus body;

a secured part that is provided in the detachable component and that is secured to a predetermined securing position on an apparatus body side; and a regulating part that is provided on the apparatus body side and that regulates a movement of the secured part secured to the securing position, the regulating part being an L-shaped plate member, wherein, during attachment of the detachable component to the apparatus body, the secured part is brought into contact with the regulating part so as to be displaced or set in a state changed from a state before the contact of the secured part with the regulating part, and the secured part that is displaced or set in the changed state becomes able to pass the regulating part so as to reach the securing position.

2. The image forming apparatus according to claim 1, wherein the secured part includes an abutting portion, and wherein, during the attachment of the detachable component to the apparatus body, when the abutting portion of the secured part abuts the regulating part, the secured part is rotated, the rotation of the secured part releases the abutment of the abutting portion of the secured part with the regulating part so as to allow the secured part to pass the regulating part.

3. The image forming apparatus according to claim 2, further comprising:

a covering member that is able to be opened and closed relative to the apparatus body and that covers part of the apparatus body, wherein the secured part includes an interfering portion, and wherein, when the secured part of the detachable component does not reach the securing position and remains at a predetermined position after the attachment of the detachable component has been performed, the secured part is brought into contact with the regulating part and pressed by the regulating part, and the interfering portion of the secured part projects in a movement path of the covering member, and wherein, when closing of the covering member is attempted while the secured part remains at the predetermined position, the interfering portion of the secured part interferes with the covering member so as not to allow the covering member to be closed.

4. The image forming apparatus according to claim 1, wherein, during the attachment of the detachable component to the apparatus body, the secured part is moved in one direction and brought into contact with the regulating part, and wherein at least one of the secured part and the regulating part has an inclined surface inclined relative to the one direction, and when the inclined surface is brought into contact with another of the secured part and the regulating part, the secured part is moved in a direction intersecting the one direction so as to be able to pass the regulating part.

5. The image forming apparatus according to claim 4, further comprising:

a covering member that is able to be opened and closed relative to the apparatus body and that covers part of the apparatus body, wherein the secured part includes an interfering portion, and wherein, when the secured part of the detachable component does not reach the securing position and remains at a predetermined position after the attachment of the detachable component has been performed, the secured part is brought into contact with the regulating part and pressed by the regulating part, and the interfering portion of the secured part projects in a movement path of the covering member, and wherein, when closing of the covering member is attempted while the secured part remains at the predetermined position, the interfering portion of the secured part interferes with the covering member so as not to allow the covering member to be closed.

6. The image forming apparatus according to claim 1, further comprising:

a covering member that is able to be opened and closed relative to the apparatus body and that covers part of the apparatus body, wherein the secured part includes an interfering portion, and wherein, when the secured part of the detachable component does not reach the securing position and remains at a predetermined position after the attachment of the detachable component has been performed, the secured part is brought into contact with the regulating part and pressed by the regulating part, and the interfering portion of the secured part projects in a movement path of the covering member, and wherein, when closing of the covering member is attempted while the secured part remains at the predetermined position, the interfering portion of the secured part interferes with the covering member so as not to allow the covering member to be closed.

7. An image forming apparatus comprising:

an apparatus body;

a detachable component attachable to and detachable from the apparatus body;

a secured part that is provided in the detachable component, that is secured to a predetermined securing position on an apparatus body side, and that is moved in a predetermined movement path during attachment or detachment of the detachable component to or from the apparatus body; and a regulating part that is provided on the apparatus body side, that is positioned in the movement path, and that regulates a movement of the secured part secured at the securing position, wherein, during the attachment of the detachable component to the apparatus body, the regulating part positioned in the movement path is pressed by the secured part that is being moved in the movement path, the regulating part pressed by the secured part is temporarily retracted from the movement path, thereby allowing the secured part to pass the regulating part so as to reach the securing position, the regulating part being retracted and returned to the movement path by virtue of an urging spring.

8. The image forming apparatus according to claim 7, wherein, during the attachment of the detachable component to the apparatus body, the secured part is moved in one direction and brought into contact with the regulating part, and wherein at least one of the secured part and the regulating part has an inclined surface inclined relative to the one direction, and when the inclined surface is brought into contact with another of the secured part and the regulating part, the regulating part is moved in a direction intersecting the one direction and retracted from the movement path.

9. The image forming apparatus according to claim 8, further comprising:

a covering member that is able to be opened and closed relative to the apparatus body and that covers part of the apparatus body, wherein the secured part includes an interfering portion, and wherein, when the secured part of the detachable component does not reach the securing position and remains at a predetermined position after the attachment of the detachable component has been performed, the secured part is brought into contact with the regulating part and pressed by the regulating part, and the interfering portion of the secured part projects in a movement path of the covering member, and wherein, when closing of the covering member is attempted while the secured part remains at the predetermined position, the interfering portion of the secured part interferes with the covering member so as not to allow the covering member to be closed.

10. The image forming apparatus according to claim 7, wherein the movement path is bent in the middle thereof, wherein, during the attachment of the detachable component to the apparatus body, the secured part is moved in one direction, reaches a predetermined point, and then is moved in a direction intersecting the one direction, wherein the regulating part is disposed at the predetermined point, and wherein the secured part that is being moved in the one direction and that reaches the predetermined point presses the regulating part so as to move the regulating part to a downstream side in the one direction and retract the regulating part from the movement path.

11. The image forming apparatus according to claim 10, further comprising:

a covering member that is able to be opened and closed relative to the apparatus body and that covers part of the apparatus body, wherein the secured part includes an interfering portion, and wherein, when the secured part of the detachable component does not reach the securing position and remains at a predetermined position after the attachment of the detachable component has been performed, the secured part is brought into contact with the regulating part and pressed by the regulating part, and the interfering portion of the secured part projects in a movement path of the covering member, and wherein, when closing of the covering member is attempted while the secured part remains at the predetermined position, the interfering portion of the secured part interferes with the covering member so as not to allow the covering member to be closed.

12. The image forming apparatus according to claim 7, further comprising:

a covering member that is able to be opened and closed relative to the apparatus body and that covers part of the apparatus body, wherein the secured part includes an interfering portion, and wherein, when the secured part of the detachable component does not reach the securing position and remains at a predetermined position after the attachment of the detachable component has been performed, the secured part is brought into contact with the regulating part and pressed by the regulating part, and the interfering portion of the secured part projects in a movement path of the covering member, and wherein, when closing of the covering member is attempted while the secured part remains at the predetermined position, the interfering portion of the secured part interferes with the covering member so as not to allow the covering member to be closed.

13. A detachable component comprising:

a detachable component body attachable to and detachable from an image forming apparatus that includes a regulating part that regulates a movement of a member, the regulating part being an L-shaped plate member; and a secured part, wherein, during attachment of the detachable component body to the image forming apparatus, the secured part is brought into contact with the regulating part so as to be displaced or set in a state changed from a state before the contact of the secured part with the regulating part, the secured part that is displaced or set in the changed state becomes able to pass the regulating part, the secured part having passed the regulating part reaches a regulated position where the regulating part regulates a movement, and the secured part is secured to the image forming apparatus.

14. A detachable component comprising:

a detachable component body attachable to and detachable from an image forming apparatus that includes a regulating part that regulates a movement of a member; and a secured part, wherein, during attachment of the detachable component body to the image forming apparatus, the secured part is moved in a predetermined movement path and presses the regulating part positioned in the movement path so as to temporarily retract the regulating part from the movement path and passes the regulating part, the secured part having passed the regulating part reaches a regulated position where the regulating part regulates a movement, and the secured part is secured to the image forming apparatus, the regulating part being retracted and returned to the movement path by virtue of an urging spring.

* * * * *